US011211688B2

(12) United States Patent
Asaf et al.

(10) Patent No.: US 11,211,688 B2
(45) Date of Patent: Dec. 28, 2021

(54) HYBRID AND THINNED MILLIMETER-WAVE ANTENNA SOLUTIONS

(71) Applicant: Intel Corporation, Santa Clara, CA (US)

(72) Inventors: Omer Asaf, Oranit (IL); Nir Weisman, Hod Hasharon (IL); Naftali Landsberg, Ramat Gan (IL); Eyal Goldberger, Moshav Beherotaim (IL); Pablo Herrero, Munich (DE); Harry G. Skinner, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 16/638,567

(22) PCT Filed: Sep. 28, 2018

(86) PCT No.: PCT/US2018/053268

§ 371 (c)(1),
(2) Date: Feb. 12, 2020

(87) PCT Pub. No.: WO2019/070509

PCT Pub. Date: Apr. 11, 2019

(65) Prior Publication Data

US 2020/0220249 A1 Jul. 9, 2020

Related U.S. Application Data

(60) Provisional application No. 62/567,435, filed on Oct. 3, 2017.

(51) Int. Cl.
*H01Q 1/22* (2006.01)
*H01Q 21/06* (2006.01)
(Continued)

(52) U.S. Cl.
CPC ..... *H01Q 1/2283* (2013.01); *H01Q 1/245* (2013.01); *H01Q 1/523* (2013.01); *H01Q 9/0414* (2013.01);
(Continued)

(58) Field of Classification Search
CPC ..... H01Q 1/22; H01Q 1/2283; H01Q 1/24; H01Q 1/245; H01Q 1/523; H01Q 9/0414;
(Continued)

(56) References Cited

U.S. PATENT DOCUMENTS 5,444,452 A * 8/1995 Itoh ..... H01Q 5/42 343/700 MS
2003/0146872 A1* 8/2003 Kellerman ..... H01Q 5/385 343/700 MS
(Continued)

FOREIGN PATENT DOCUMENTS

CN 111095675 5/2020
EP 2546927 A1 1/2013
(Continued)

OTHER PUBLICATIONS

"International Application Serial No. PCT/US2018/053268, International Search Report dated Feb. 1, 2019", 3 pgs.
(Continued)

*Primary Examiner* — Thai Pham
(74) *Attorney, Agent, or Firm* — Schwegman Lundberg & Woessner, P.A.

(57) ABSTRACT

Apparatuses and systems for millimeter-wave antennas are described. An apparatus comprises a board assembly, and a first and second antenna disposed within the board assembly. A third antenna can comprise a semiconductor antenna attached to the board assembly. A parasitic layer can be gap-coupled to the first and second antenna. The first and
(Continued)

second antenna can include a rectangular patch antenna and an annular ring antenna. Other aspects are described.

4 Claims, 11 Drawing Sheets

(51) Int. Cl.
*H01Q 1/24* (2006.01)
*H01Q 1/52* (2006.01)
*H01Q 9/04* (2006.01)

(52) U.S. Cl.
CPC ..... *H01Q 9/0457* (2013.01); *H01Q 21/065* (2013.01)

(58) Field of Classification Search
CPC .... H01Q 9/0457; H01Q 21/06; H01Q 21/065; H01Q 25/001; H01Q 5/40
See application file for complete search history.

(56) References Cited

U.S. PATENT DOCUMENTS

2007/0080864 A1* 4/2007 Channabasappa ..... H01Q 13/18 343/700 MS
2007/0171071 A1* 7/2007 Chiu ..... H01Q 1/2208 340/572.7
2010/0090903 A1* 4/2010 Byun ..... H01Q 13/18 343/700 MS
2013/0099982 A1* 4/2013 Andrenko ..... H01Q 5/40 343/700 MS
2014/0028515 A1 1/2014 Lu et al.
2014/0145883 A1* 5/2014 Baks ..... H01Q 1/2283 343/700 MS
2014/0361952 A1* 12/2014 Dobric ..... H01Q 1/3275 343/893
2016/0028162 A1 1/2016 Ou et al.
2016/0172763 A1* 6/2016 Teoh ..... H01Q 9/045 343/841
2019/0221935 A1* 7/2019 Chen ..... H01Q 21/30

FOREIGN PATENT DOCUMENTS

EP 3065220 A1 9/2016
KR 20090100866 A 9/2009
KR 20120062622 A 6/2012
KR 20130023104 A 3/2013
WO WO-2019070509 A1 4/2019

OTHER PUBLICATIONS

"International Application Serial No. PCT/US2018/053268, Written Opinion dated Feb. 1, 2019", 6 pgs.
"International Application Serial No. PCT US2018 053268, International Preliminary Report on Patentability dated Apr. 16, 2020", 8 pgs.
"European Application Serial No. 18863918.1, Partial Supplementary European Search Report dated Jun. 7, 2021", 16 pgs.

* cited by examiner

HYBRID AND THINNED MILLIMETER-WAVE ANTENNA SOLUTIONS

PRIORITY CLAIM

This application is a U.S. National Stage Filing under 35 U.S.C. 371 from International Application No. PCT/US2018/053268, filed on Sep. 28, 2018, and published as WO 2019/070509, which claims the benefit of priority to U.S. Provisional Patent Application Ser. No. 62/567,435, filed Oct. 3, 2017, and titled "MILLIMETER-WAVE ANTENNA ARRAY SOLUTION FOR 5TH GENERATION OF MOBILE NETWORKS", each of which is incorporated herein by reference in their entirety.

TECHNICAL FIELD

Aspects described herein relate generally to methods and apparatus wireless communication; and more particularly relate to methods and apparatus for a millimeter(mm)-wave antenna array.

BACKGROUND

Evolving mobile devices will support at least three different millimeter (mm)-wave bands (24-29.5 GHz, 37-43.5 GHz and 57-70 GHz). Some products will be expected to support all three bands, while other products will be expected to support only the lower two of the bands. Designing two types of products in parallel can be expensive. Furthermore, antennas for such mobile devices add to the thickness of the mobile devices. Extra thickness may be undesirable to mobile device customers.

DETAILED DESCRIPTION

The following description and the drawings sufficiently illustrate specific aspects to enable those skilled in the art to practice them. Other aspects may incorporate structural, logical, electrical, process, and other changes. Portions and features of some aspects may be included in, or substituted for, those of other embodiments. Aspects set forth in the claims encompass all available equivalents of those claims.

Figure 1:
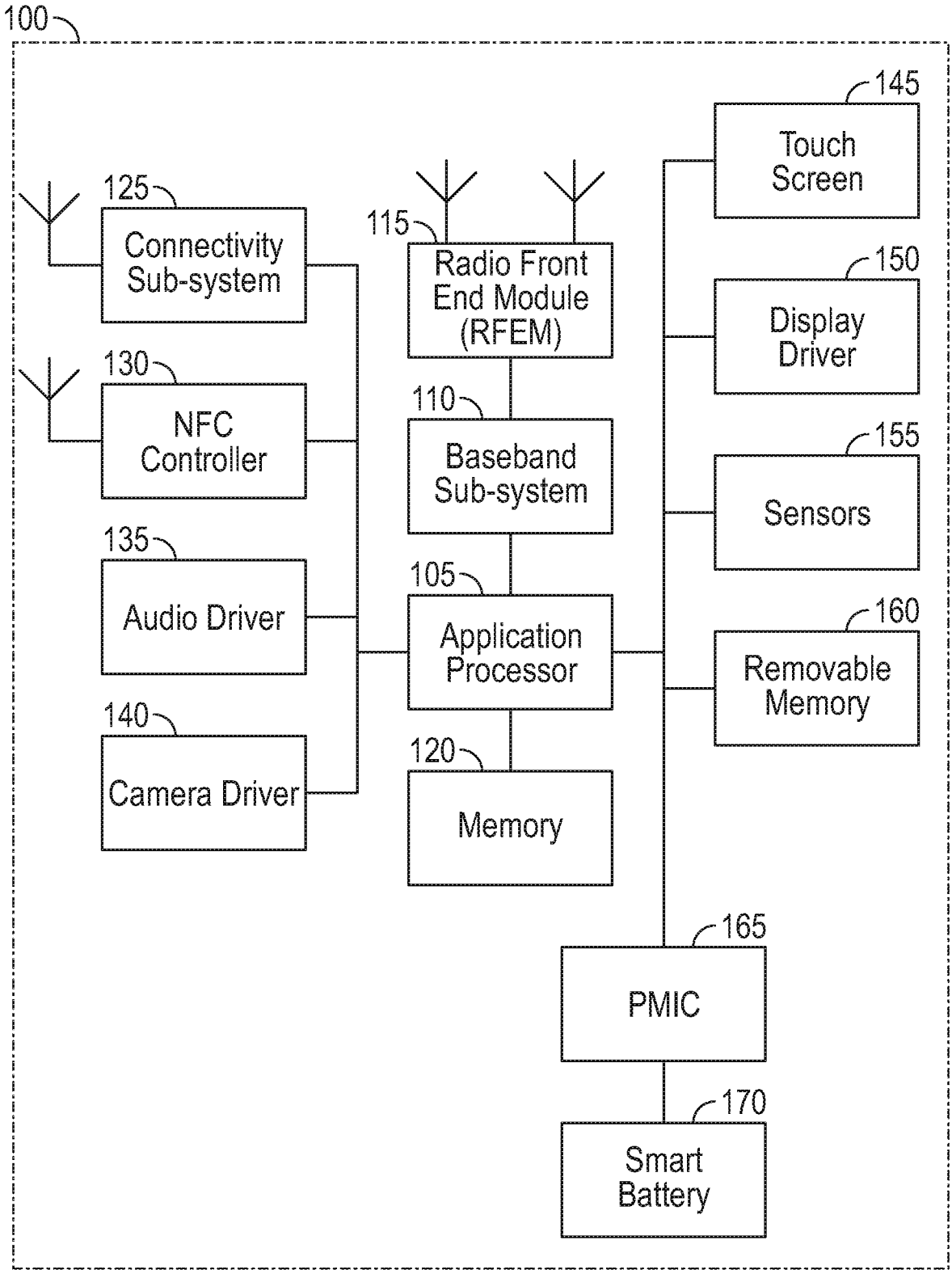
FIG. 1 illustrates an exemplary user device according to some aspects.

FIG. 1 illustrates an exemplary user device according to some aspects. The user device 100, in some aspects, can include antenna aspects as described later herein. The user device 100 may be a mobile device in some aspects and includes an application processor 105, baseband processor 110 (also referred to as a baseband sub-system), radio front end module (RFEM) 115, memory 120, connectivity sub-system 125, near field communication (NFC) controller 130, audio driver 135, camera driver 140, touch screen 145, display driver 150, sensors 155, removable memory 160, power management integrated circuit (PMIC) 165, and smart battery 170. RFEM 115 can couple to antennas as described later herein.

In some aspects, application processor 105 may include, for example, one or more central processing unit (CPU) cores and one or more of cache memory, low drop-out voltage regulators (LDOs), interrupt controllers, serial interfaces such as SPI, I2C or universal programmable serial interface sub-system, real time clock (RTC), timer-counters including interval and watchdog timers, general purpose TO, memory card controllers such as SD/MMC or similar, USB interfaces, MIPI interfaces, and/or Joint Test Access Group (JTAG) test access ports.

In some aspects, baseband processor 110 may be implemented, for example, as a solder-down substrate including one or more integrated circuits, a single packaged integrated circuit soldered to a main circuit board, and/or a multi-chip module including two or more integrated circuits.

Figure 2:
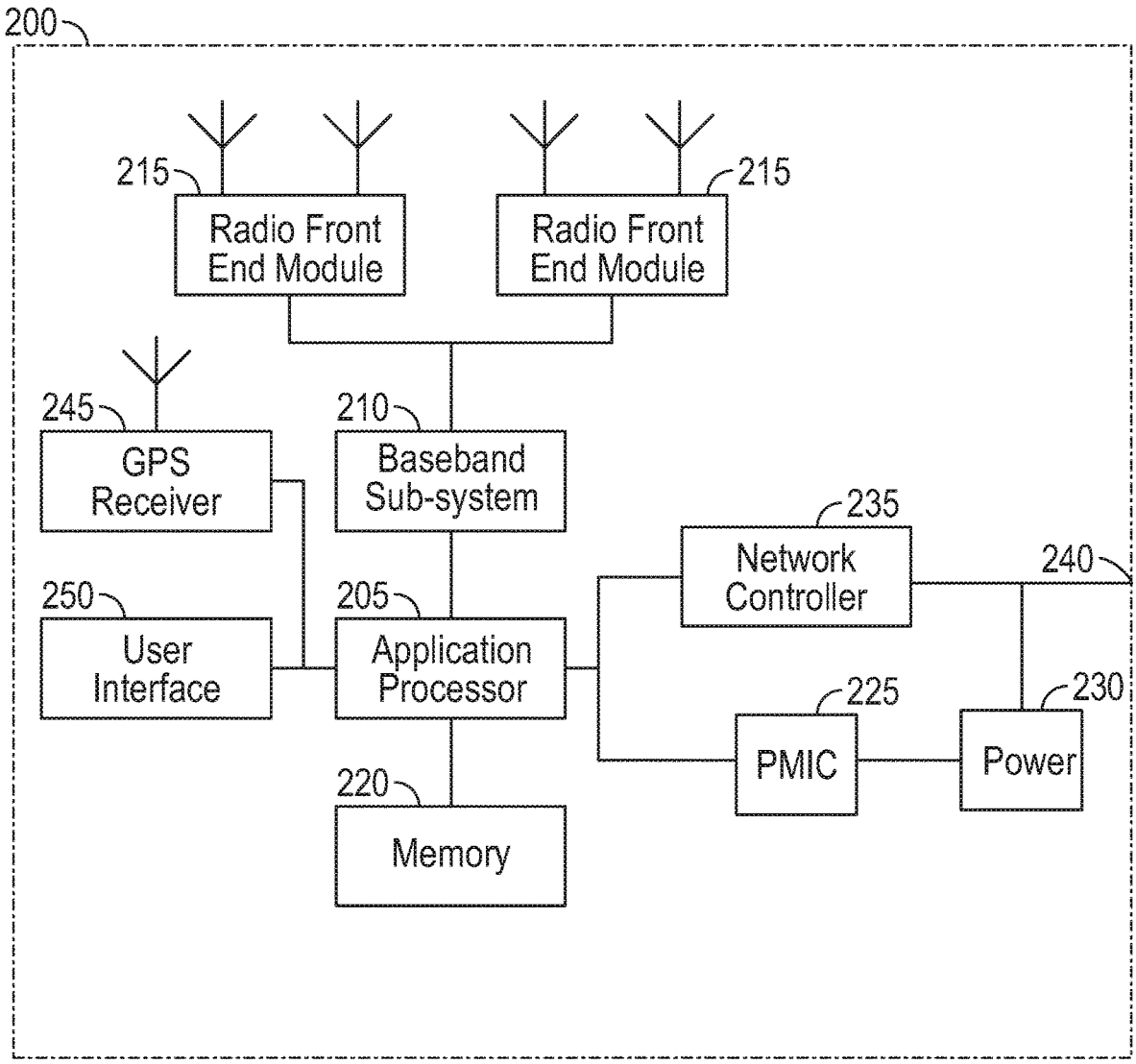
FIG. 2 illustrates an exemplary base station radio head according to some aspects.

FIG. 2 illustrates an exemplary base station or infrastructure equipment radio head according to some aspects. A base station may be termed, for example, an Evolved Node-B (eNB, eNodeB), or a New Radio Node-B (gNB, gNodeB). In some aspects, the base station radio head 200 may include one or more of application processor 205, baseband processors 210, one or more radio front end modules 215, memory 220, power management integrated circuitry (PMIC) 225, power tee circuitry 230, network controller 235, network interface connector 240, satellite navigation receiver (e.g., GPS receiver) 245, and user interface 250.

In some aspects, application processor 205 may include one or more CPU cores and one or more of cache memory, low drop-out voltage regulators (LDOs), interrupt controllers, serial interfaces such as SPI, I2C or universal programmable serial interface, real time clock (RTC), timer-counters including interval and watchdog timers, general purpose IO, memory card controllers such as SD/MMC or similar, USB interfaces, MIPI interfaces and Joint Test Access Group (JTAG) test access ports.

In some aspects, baseband processor 210 may be implemented, for example, as a solder-down substrate including one or more integrated circuits, a single packaged integrated circuit soldered to a main circuit board or a multi-chip sub-system including two or more integrated circuits.

In some aspects, memory 220 may include one or more of volatile memory including dynamic random access memory (DRAM) and/or synchronous DRAM (SDRAM), and non-volatile memory (NVM) including high-speed electrically erasable memory (commonly referred to as Flash memory), phase-change random access memory (PRAM), magneto-resistive random access memory (MRAM), and/or a three-dimensional cross point memory. Memory 220 may be implemented as one or more of solder down packaged integrated circuits, socketed memory modules and plug-in memory cards.

In some aspects, power management integrated circuitry 225 may include one or more of voltage regulators, surge protectors, power alarm detection circuitry and one or more backup power sources such as a battery or capacitor. Power alarm detection circuitry may detect one or more of brown out (under-voltage) and surge (over-voltage) conditions.

In some aspects, power tee circuitry 230 may provide for electrical power drawn from a network cable. Power tee circuitry 230 may provide both power supply and data connectivity to the base station radio head 200 using a single cable.

In some aspects, network controller 235 may provide connectivity to a network using a standard network interface protocol such as Ethernet. Network connectivity may be provided using a physical connection which is one of electrical (commonly referred to as copper interconnect), optical or wireless.

In some aspects, satellite navigation receiver 245 may include circuitry to receive and decode signals transmitted by one or more navigation satellite constellations such as the global positioning system (GPS), Globalnaya Navigatsionnaya Sputnikovaya Sistema (GLONASS), Galileo and/or BeiDou.

The receiver 245 may provide, to application processor 205, data which may include one or more of position data or time data. Time data may be used by application processor 205 to synchronize operations with other radio base stations or infrastructure equipment.

In some aspects, user interface 250 may include one or more of buttons. The buttons may include a reset button. User interface 250 may also include one or more indicators such as LEDs and a display screen.

Figure 3:
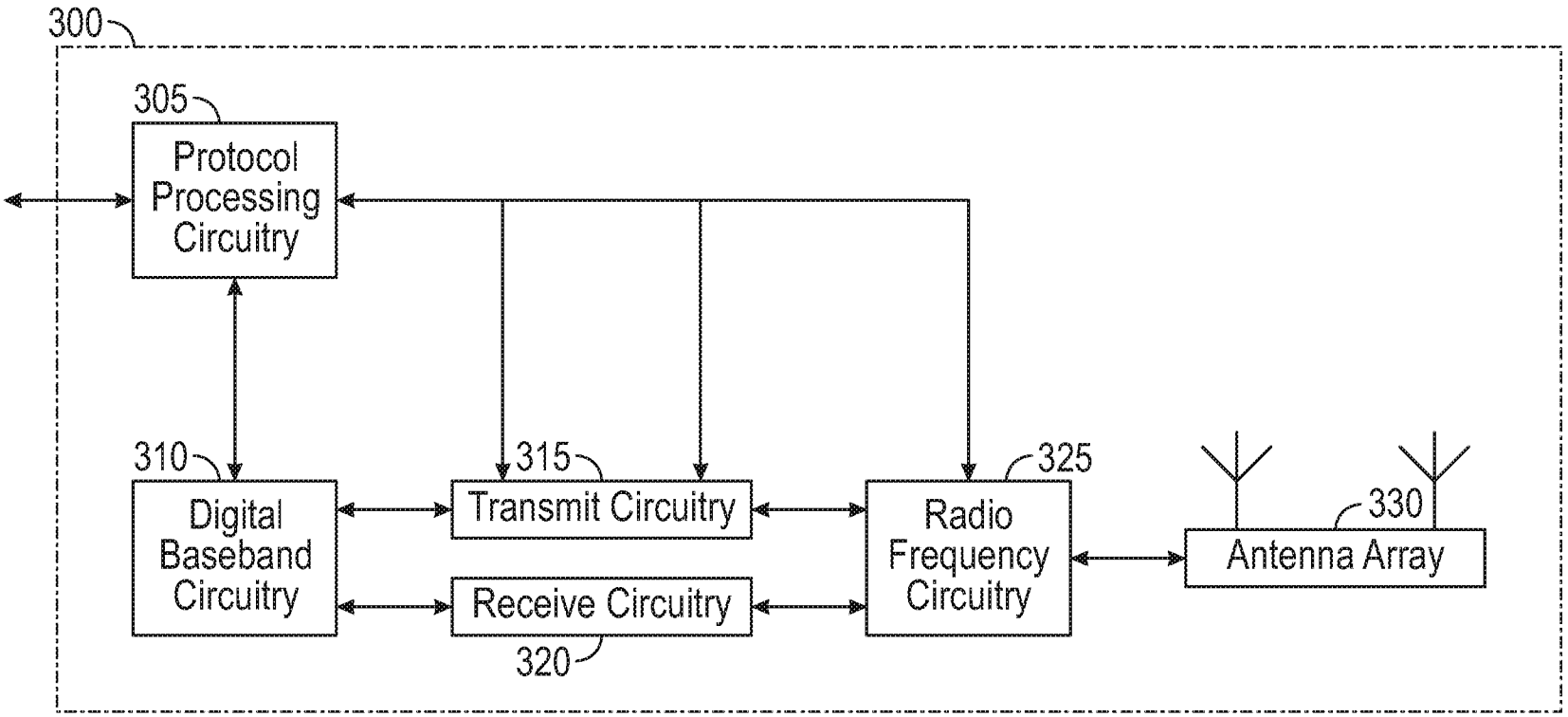
FIG. 3 illustrates exemplary communication circuitry according to some aspects.

FIG. 3 illustrates exemplary communication circuitry according to some aspects. Communication circuitry 300 shown in FIG. 3 may be alternatively grouped according to functions. Components illustrated in FIG. 3 are provided here for illustrative purposes and may include other components not shown in FIG. 3.

Communication circuitry 300 may include protocol processing circuitry 305 (or processor) or other means for processing. Protocol processing circuitry 305 may implement one or more of medium access control (MAC), radio link control (RLC), packet data convergence protocol (PDCP), radio resource control (RRC) and non-access stratum (NAS) functions, among others. Protocol processing circuitry 305 may include one or more processing cores to execute instructions and one or more memory structures to store program and data information.

Communication circuitry 300 may further include digital baseband circuitry 310. Digital baseband circuitry 310 may implement physical layer (PHY) functions including one or more of hybrid automatic repeat request (HARQ) functions, scrambling and/or descrambling, coding and/or decoding, layer mapping and/or de-mapping, modulation symbol mapping, received symbol and/or bit metric determination, multi-antenna port pre-coding and/or decoding which may include one or more of space-time, space-frequency or spatial coding, reference signal generation and/or detection, preamble sequence generation and/or decoding, synchronization sequence generation and/or detection, control channel signal blind decoding, link adaptation, and other related functions.

Communication circuitry 300 may further include transmit circuitry 315, receive circuitry 320 and/or antenna array circuitry 330. Communication circuitry 300 may further include RF circuitry 325. In some aspects, RF circuitry 325 may include one or multiple parallel RF chains for transmission and/or reception. Each of the RF chains may be connected to one or more antennas of antenna array circuitry 330. Antenna array circuitry can include antenna aspects described later herein.

In some aspects, protocol processing circuitry 305 may include one or more instances of control circuitry. The control circuitry may provide control functions for one or more of digital baseband circuitry 310, transmit circuitry 315, receive circuitry 320, and/or RF circuitry 325.

Millimeter Wave Antenna Solutions

Evolving mobile devices are anticipated to address three different mm-wave bands (24-29.5 GHz, 37-43.5 GHz and 57-70 GHz). Some devices will only need to support the lower two bands. The lower two bands can include dual polarized capabilities to support multiple-input multiple-output (MIMO). For such support, an example antenna can include a coupled annular ring patch with rectangular patch. The high band (57-70 GHz) can be optional in some future devices. In certain examples, a first part of the devices can support the lower two bands and second part of the devices can support all the three bands. In addition, the RF signals from a silicon chip coupled to the antenna elements may contain both the lower bands on a single trace, which means only one feed trace per polarization. Having only a single feed per polarization can therefore simplify the board routing density.

In certain examples, the antenna elements supporting the at least two lower bands can be extracted in a board assembly (e.g., a laminated board assembly or dielectric board assembly) while the antenna elements supporting the high band can be on-chip antennas extracted in the die process. These examples can be referred to as a hybrid solution. In certain examples, an antenna element for the lower bands can use an inherent diplexer applied to the antenna element structure which contains coupled rectangular and annular patches. In certain examples, a single package is provided that can include the two lower band antennas and the optional high band antenna. In such an example, a board and package can be designed once while the silicon circuits for the high band can be added according to the required product. In certain examples, a thinned solution can include a rectangular patch antenna inside an annular patch antenna with gap coupled parasitics enclosing the annular patch antenna.

Hybrid Antenna Array Solution

Figure 4:
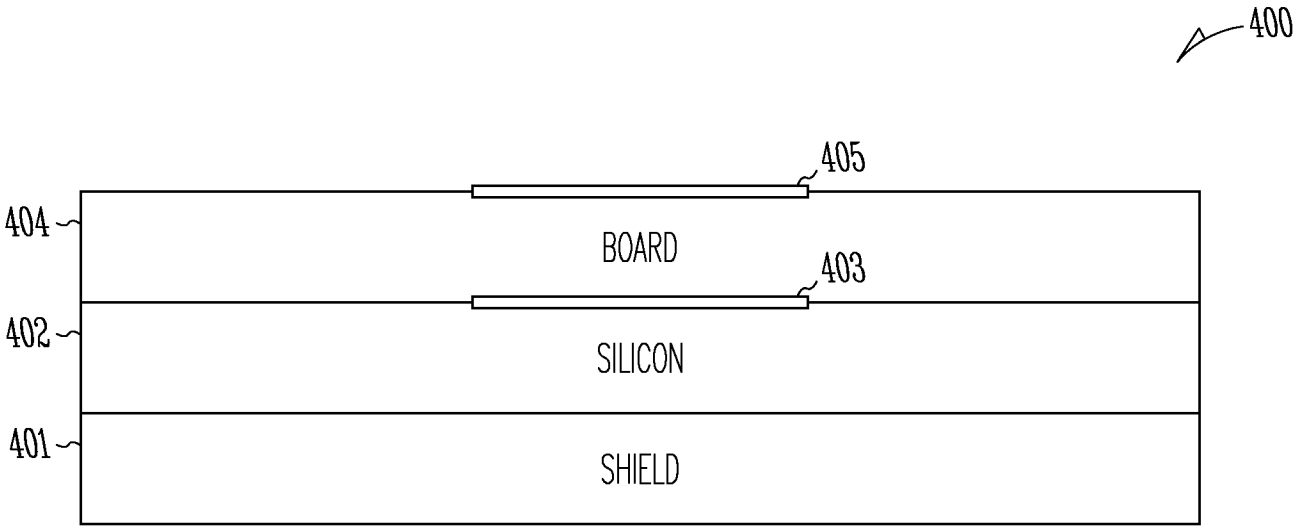
FIG. 4 illustrates generally a block diagram of an example antenna structure according to some aspects.

FIG. 4 illustrates generally a block diagram of an example antenna structure 400 according to some aspects. The antenna structure can include a shield 401, a semiconductor circuit 402, for example, a silicon-based semiconductor circuit, a semiconductor antenna circuit 403, such as an antenna array, fabricated as part of the semiconductor circuit, a board 404, and a board antenna circuit, such as an antenna array 405, fabricated as part of the board. In certain examples, the semiconductor antenna circuit can provide an antenna array for a high frequency band and the board antenna circuit can provide antenna arrays for one or more lower frequency bands. In certain examples, the board antenna circuit can be formed in a board (e.g., a laminated or dielectric board). In some examples, the board antenna circuit can include antennas for transmitting or receiving a first frequency band and a second frequency band. In some examples, the first frequency band can have a first polarization and the second frequency band can have a second polarization.

Figure 5:
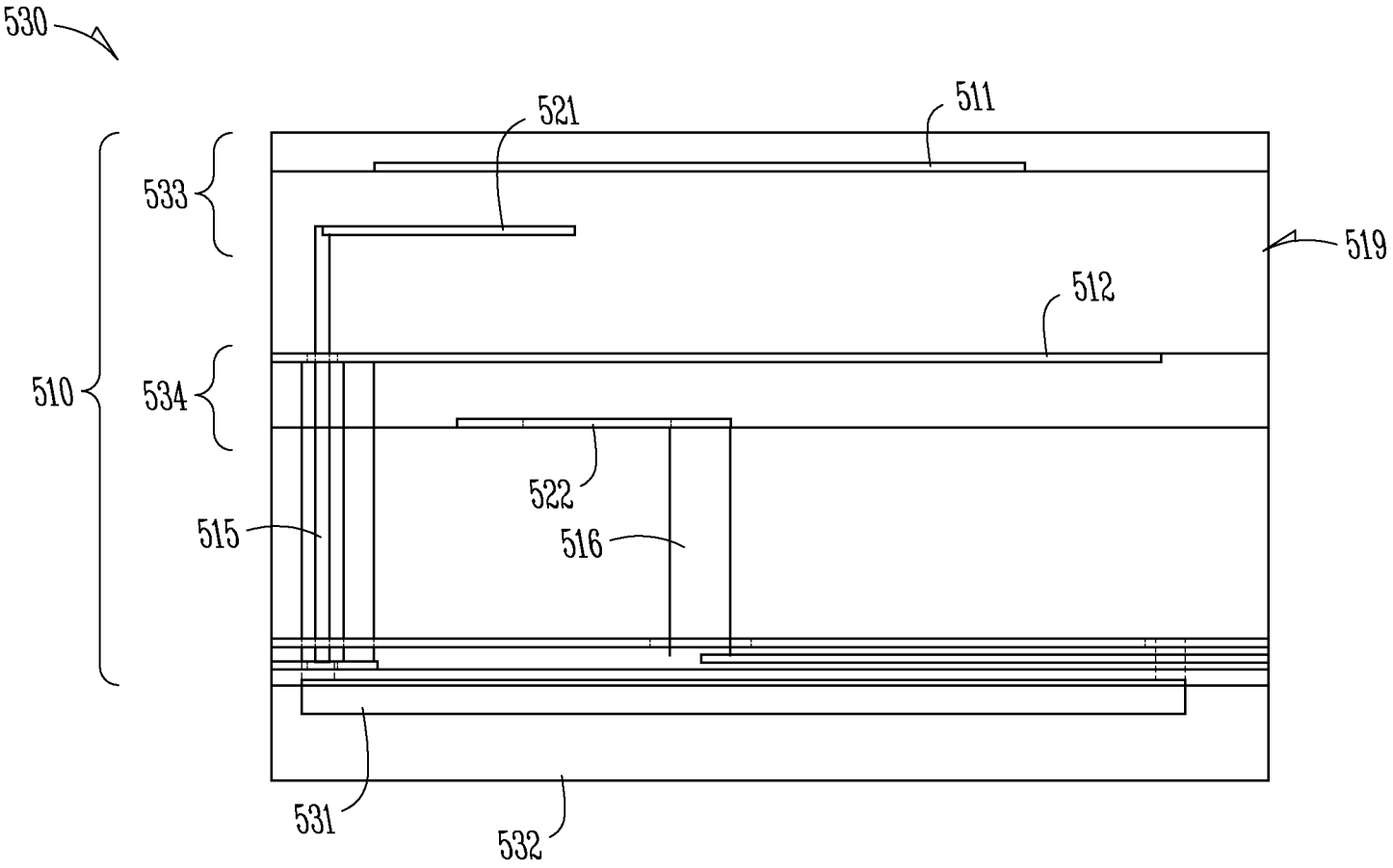
FIG. 5 illustrates a side view of an example antenna structure according to some aspects.

FIG. 5 illustrates a side view of an example antenna structure 530 according to some aspects. The structure 530 can include a silicon antenna 531 on chip 532 (AOC), and a board antenna structure 510. In certain examples, the silicon antenna 531 on chip 532 (AOC) can be placed and attached to the board 519 beneath the board antennas 533, 534. The board antennas 533, 534 (e.g., a first antenna or first patch antenna, and a second antenna or second patch antenna) can be patch antennas 511, 512 and each patch antenna can be indirectly excited using an upper patch antenna probe 521 or lower patch antenna probe 522 coupled to a respective feed 515, 516 as an indirect feed probe. In certain examples, a metal clearance 536 in the bottom GND layer in the board around the AOC can be used to enable the high band antenna to radiate though the board 519. The low bands (24-29.5 GHz and 37-43.5 GHz) board antenna 533, 534 can be the coupled rectangular-annular ring patches as discussed below with reference to FIGS. 6A, 6B, 7A and 7B. In certain examples, a feed 515 for the upper patch antenna probe 521 can include a waveguide or coaxial structure.

Coupled Annular Ring and Rectangular Patches

Figure 6A:
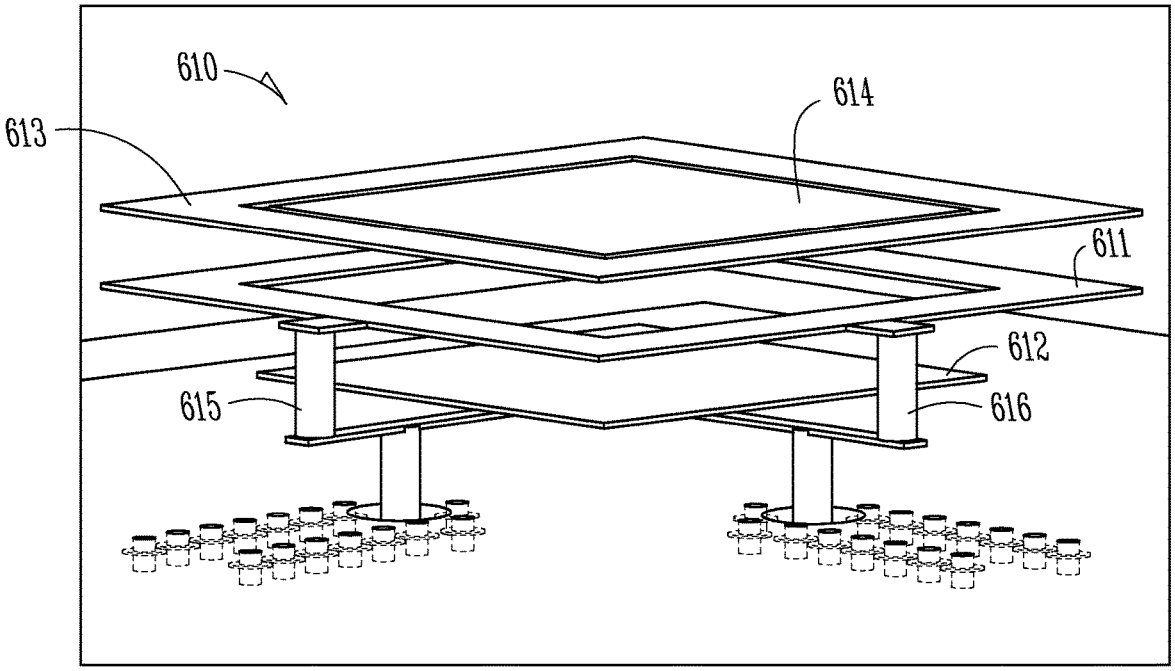
FIG. 6A illustrates generally a perspective view of a first example board antenna circuit for two frequency bands according to some aspects.
Figure 6B:
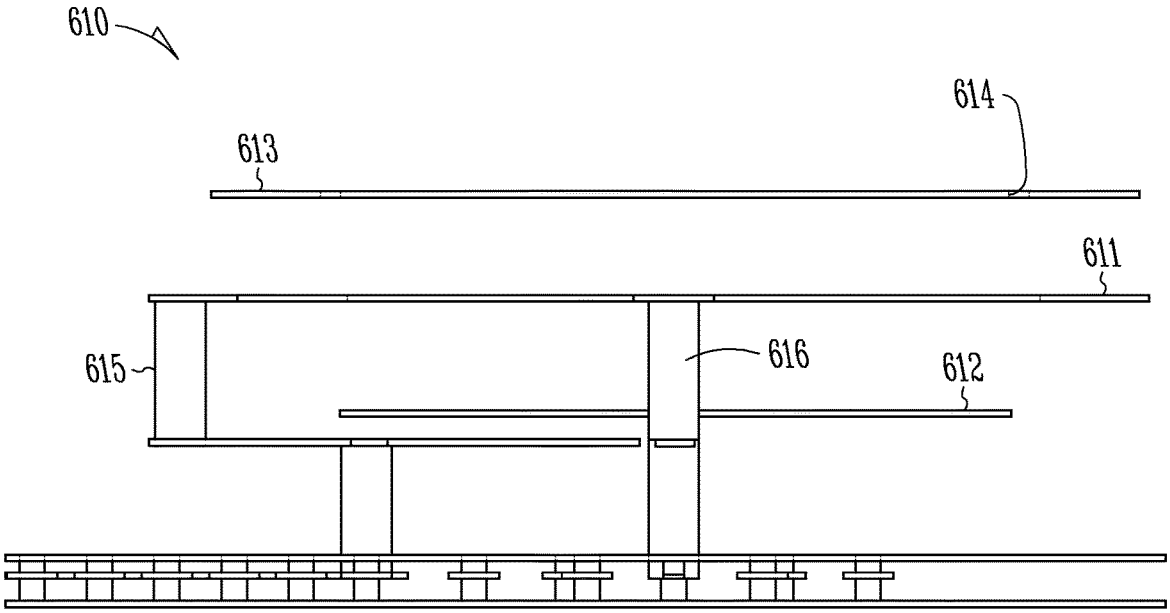
FIG. 6B illustrates generally a side-view of the board antenna circuit of FIG. 6A according to some aspects.

FIG. 6A illustrate generally a perspective view of an example board antenna circuit 610 for two frequency bands such as the lower frequency bands discussed above with respect to FIGS. 4 and 5 above. FIG. 6B illustrates generally a side-view of the board antenna circuit 610 of FIG. 6A. The board antenna circuit 610 can include dielectric build up in layers (not shown), an annular patch antenna 611, a rectangular patch antenna 612, a first parasitic patch 613, a second parasitic patch 614 and first and second feeds 615, 616. The annular patch antenna 611 can have a rectangular outside perimeter and a rectangular inside perimeter. In certain examples, the board antenna circuit 610 can support dual-feed, dual-polarized principle. In certain examples, the first parasitic patch 613 can be fabricated in a different layer than the second parasitic patch 614. In some examples, such as shown in FIGS. 6A and 6B, the first parasitic patch 613 can be fabricated in the same layer as the second parasitic patch 614. In some examples, either or both of the annular patch antenna 611 and rectangular patch antenna 612 can include a metal patch and a parasitic patch in same or different layers.

In certain examples, the board antenna circuit 610 can support the lower two bands (24-29.5 GHz and 37-43.5 GHz) as discussed above and an on-chip antenna array (not shown) can optionally be attached to the board to cover the high band (57-70 GHz) as discussed above. Since the board antenna circuit is based on an annular ring patch, the antenna can be very compact. In certain examples, the antenna element size can be about 2.4 mm×2.4 mm with BT laminate material (r=3.1, tan δ=0.004). Such a small antenna element can be part of a phased antenna solution appropriate for hand held devices or other mobile applications. In certain examples, the annular ring stacked patch can be configured to work in TM12 mode and the regular rectangular stack patch can be configured to work in TM10 mode, or vice versa.

Figure 7A:
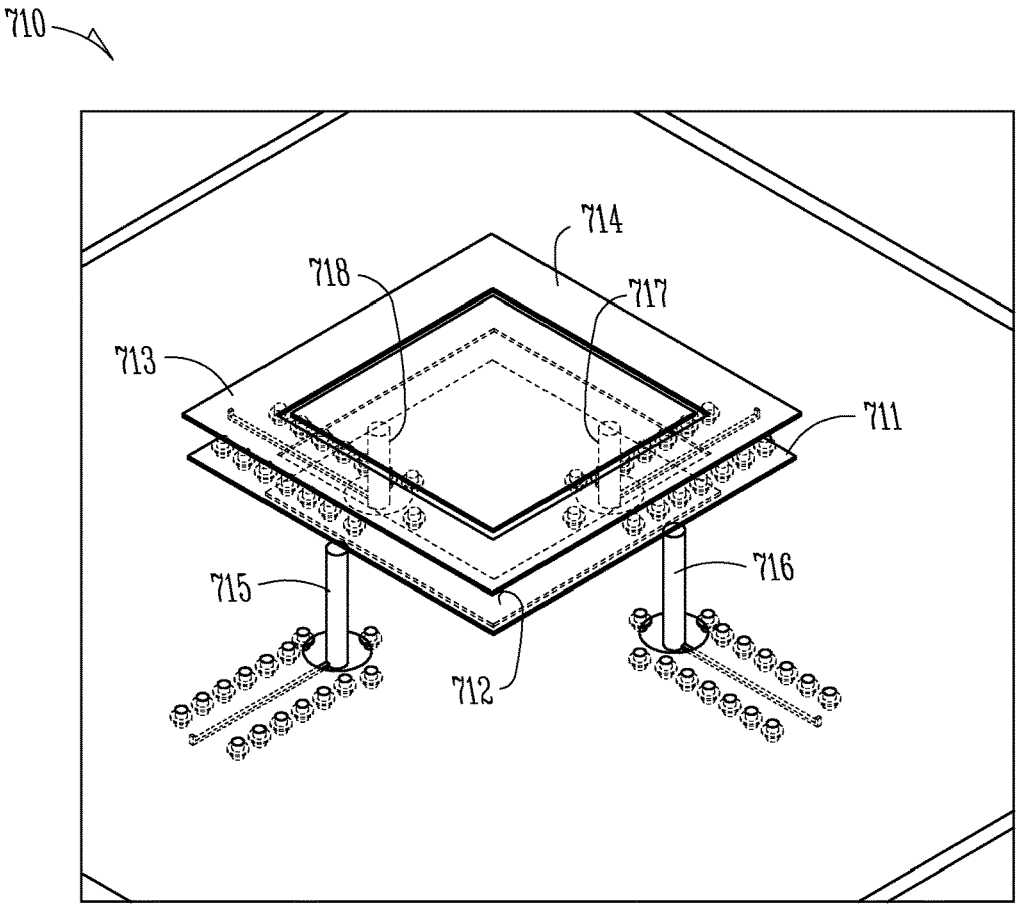
FIG. 7A illustrates generally a perspective view of a second example board antenna circuit according to some aspects.
Figure 7B:
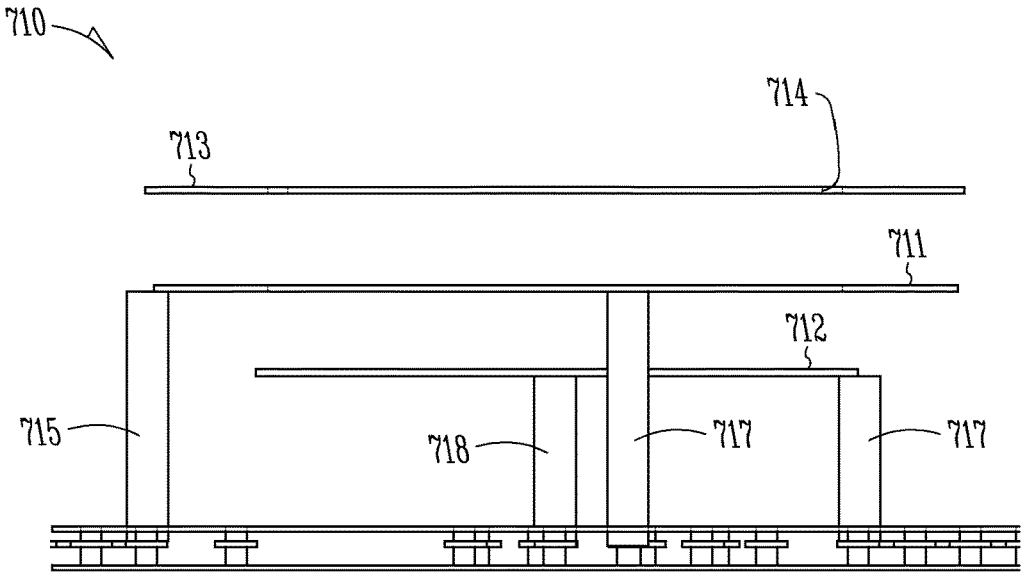
FIG. 7B illustrates generally a side-view of the board antenna circuit of FIG. 7A.

FIG. 7A illustrate generally a perspective view of an example board antenna circuit 710 for two frequency bands such as the lower frequency bands discussed above with respect to FIGS. 4 and 5. FIG. 7B illustrates generally a side-view of the board antenna circuit 710 of FIG. 7A. The board antenna circuit 710 can include dielectric build up in layers (not shown), an annular ring element 711, a regular rectangular element 712, a first parasitic patch 713, a second parasitic patch 714, and first, second, third and fourth feeds 715, 716, 717, 718. In certain examples, the board antenna circuit 710 can support quad-feed or dual-feed, dual-polarized principle. In certain examples, the first parasitic patch 713 can be fabricated in a different layer than the second parasitic patch 714. In some examples, such as shown in FIGS. 7A and 7B, the first parasitic patch 713 can be fabricated in the same layer as the second parasitic patch 714.

In certain examples, the board antenna circuit 710 can support the lower two bands (24-29.5 GHz and 37-43.5 GHz) as discussed above and an on-chip antenna array can be designed to cover the high band (57-70 GHz) as also discussed above. Since the board antenna circuit 710 is based on an annular ring patch, the antenna can be very compact. In certain examples, the antenna element size can be about 2.4 mm×2.4 mm with BT laminate material (r=3.1, tan δ=0.004). Such a small antenna element can be part of a phased antenna solution appropriate for hand held devices or other mobile applications.

Figure 8A:
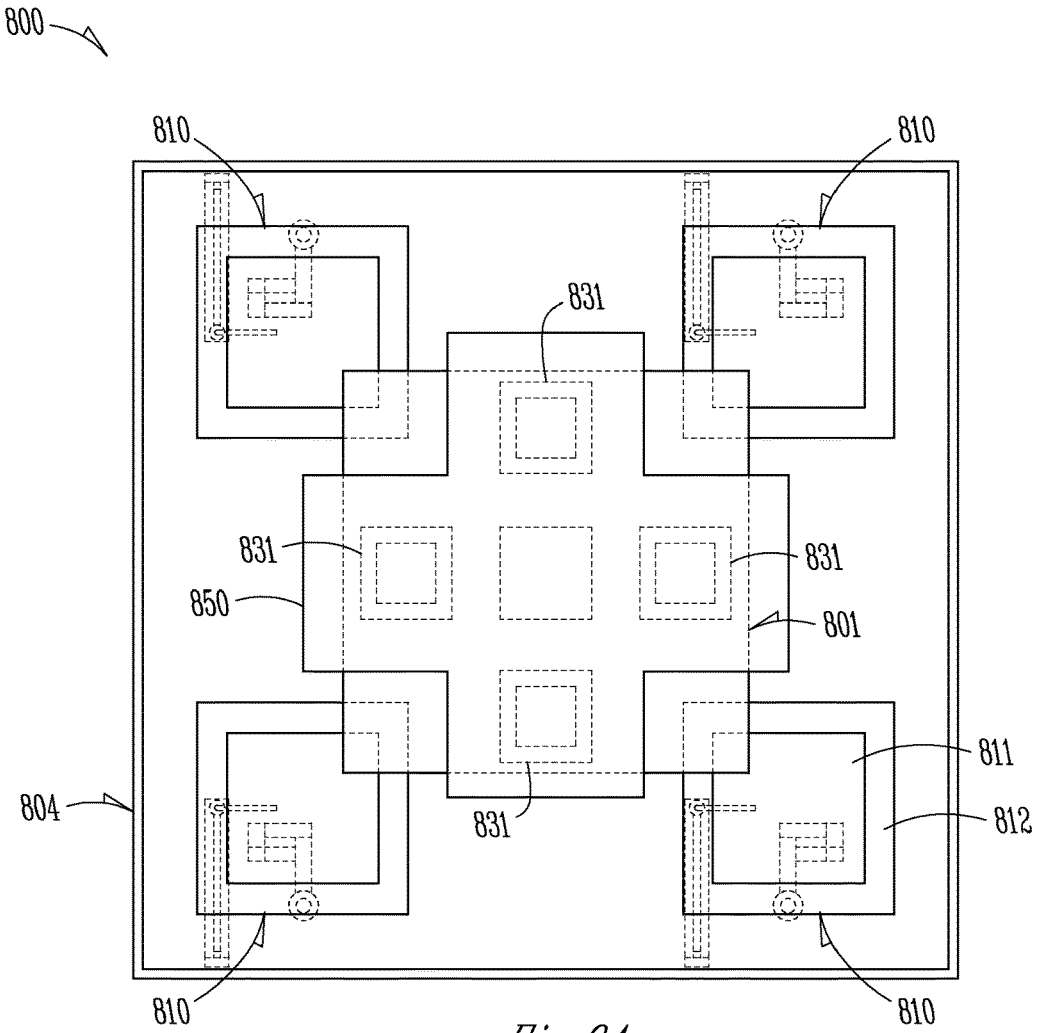
FIG. 8A illustrates a first top view of an example package according to some aspects.
Figure 8B:
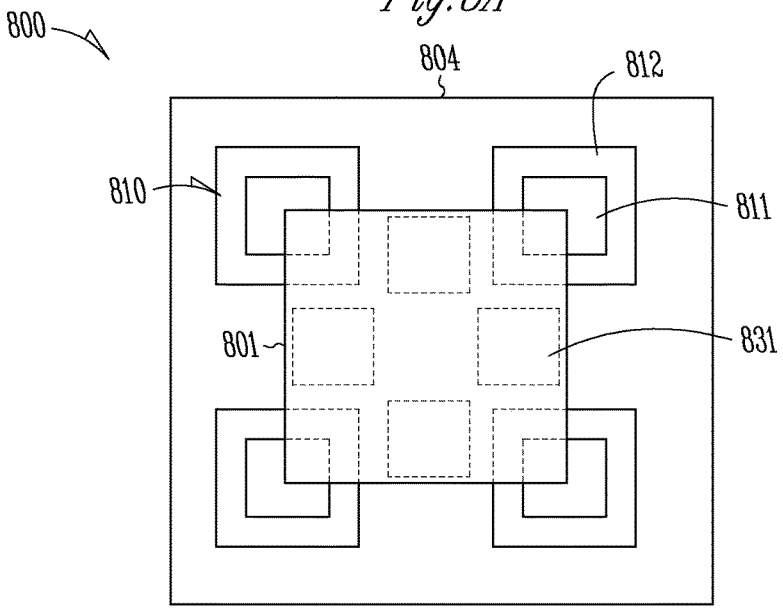
FIG. 8B illustrates a second top view of an example package according to some aspects.

FIGS. 8A and 8B illustrate a top-views of an example antenna array system 800. The package can include four high frequency band antenna elements 831 arranged in an array (e.g., as composite high frequency antenna array elements), and four combined lower frequency band elements 810 arranged in an array (e.g., as composite low frequency antenna array elements). The vertical arrangement of the high and low frequency band elements 831, 810 can be as shown in FIG. 4 with the understanding that the high frequency band elements 831 of the semiconductor chip 801 can be offset laterally from the low frequency band elements 810 of the laminated board 804.

In certain examples, the low frequency band elements can include two elements, such as, but not limited to, a 30 GHz element 811, and a 40 GHz element 812. In certain examples, the high frequency band antenna elements 831 can include, but is not limited to, a single 60 GHz element. In certain examples, the semiconductor chip 801 can be about 4 mm×4 mm or 16 $mm^2$. In certain examples, the overall dimensions of the laminated board 804 can be about 7 mm×7 mm.

In certain examples, both the low frequency array and the high frequency array can have length-wise, width-wise and diagonal symmetry. In such examples, for length-wise and width-wise symmetry of the high frequency array, and diagonal symmetry of the lower frequency array, antenna elements of the respective arrays can be halved. For length-wise and width-wise symmetry of the low frequency array, and diagonal symmetry of the high frequency array, antenna elements of the respective arrays do not need to be halved. In certain examples, a bottom GND layer of the structure can include metal clearance 850 as discussed above. In certain examples, the on-chip, or high frequency band antennas 831 can be loop-antennas. The loop antennas can provide a very compact solution which does not require extra silicon space as, in certain examples, the loop antennas can surround the high-band circuit blocks. In certain examples, the silicon technology can be 45 nm SOI. Such technology can enable a high resistive bulk, which can increase the on-chip antenna efficiency up to 80%. A full coverage below −10 dB across all the band can be achieved.

In certain examples, each of the combined low frequency band antenna elements can include patch antennas for two frequency bands as described with reference to FIGS. 4, 5, 6A, 6B, 7A, and 7B. In some examples, the two frequency bands can include a first frequency band at about 24-29.5 GHz (30 GHz) and a second frequency band at about 37-43.5 GHz (40 GHz).

In an example, the board antenna circuit can contain 5 metal layers including a GND layer, a high band feeding layer, a high band patch, a low band patch and high band and low band parasitic patches (same layer). In certain examples, the semiconductor antenna can be used for a high frequency band. In some examples, frequencies of the high frequency band can include 57-70 GHz.

Thinned 5G Antenna for Handheld Devices

Figure 9A:
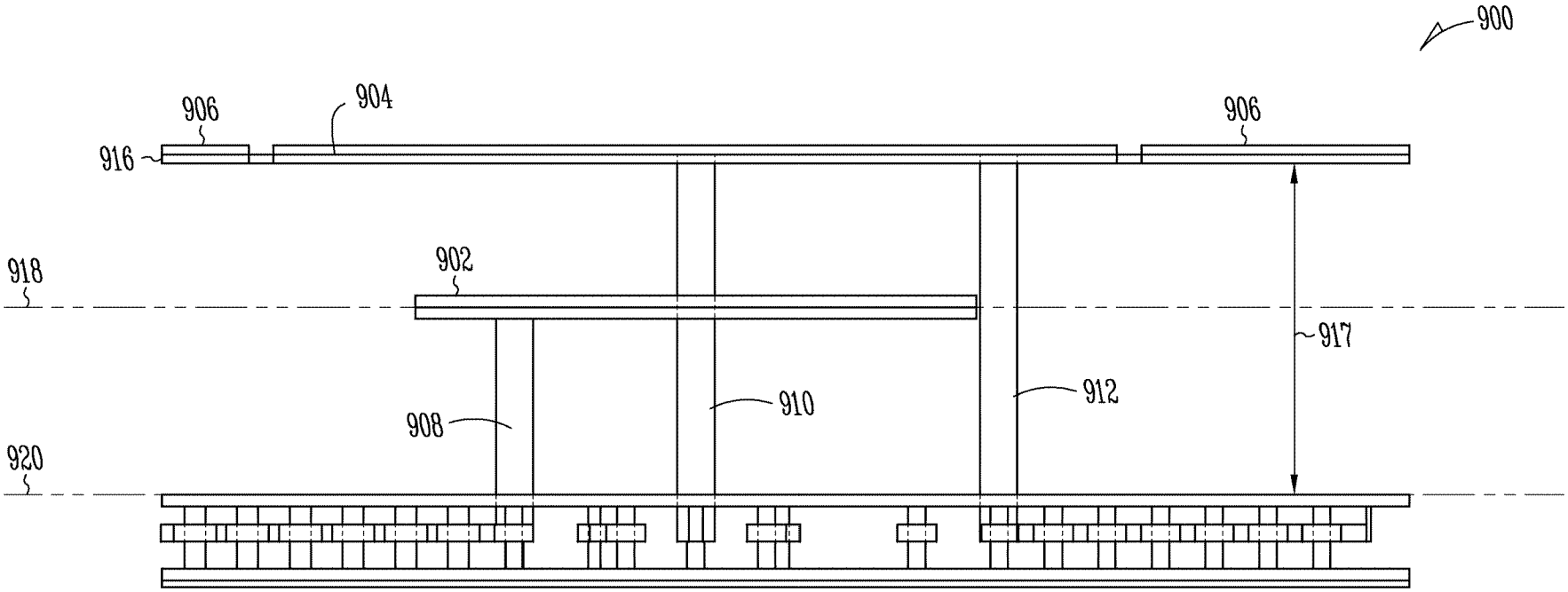
FIG. 9A illustrates a side view of a thinned antenna solution according to some aspects.
Figure 9B:
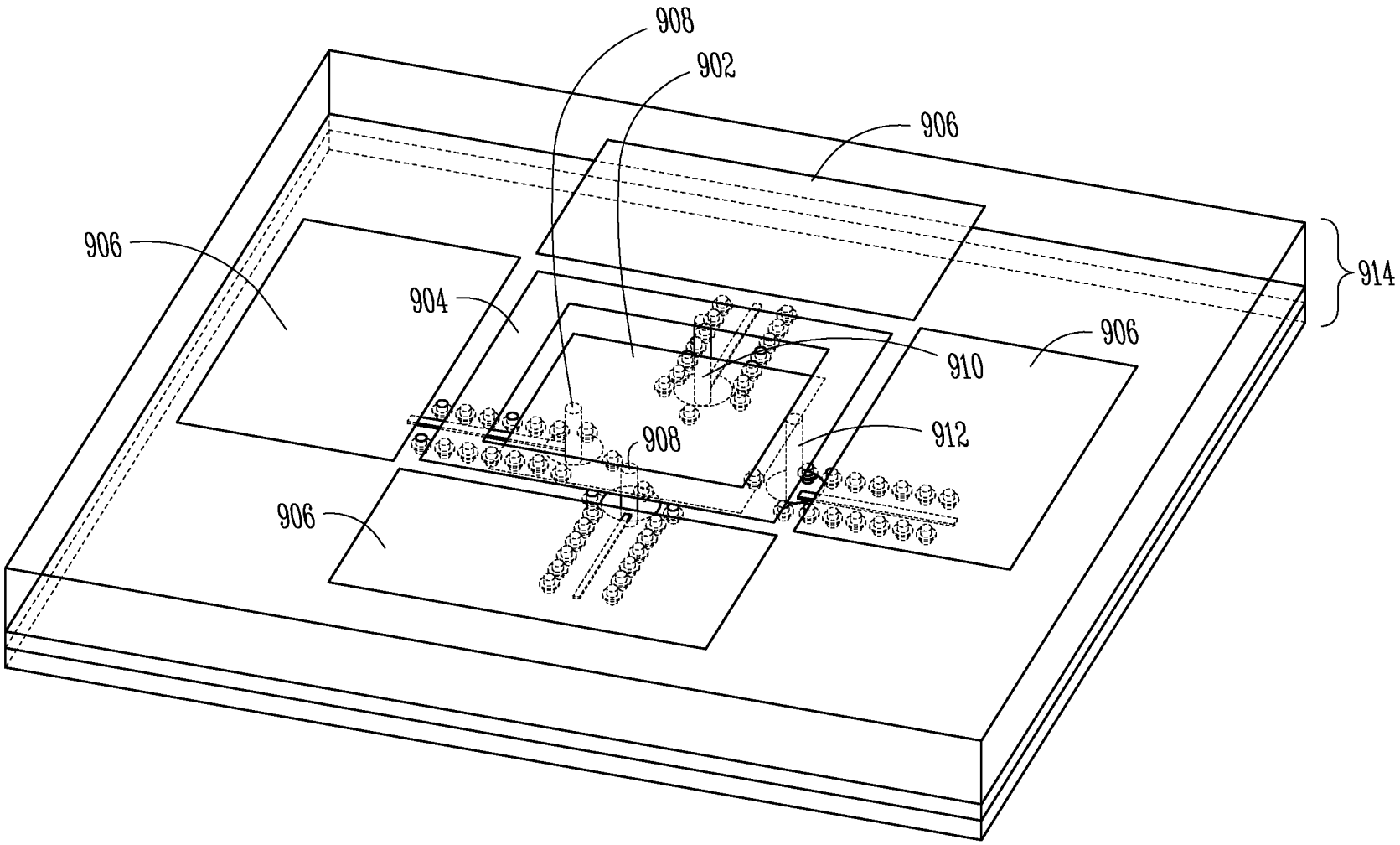
FIG. 9B illustrates a perspective view of a thinned antenna solution according to some aspects.

FIG. 9A illustrates a side view of a thinned antenna 900 apparatus in accordance with some aspects. FIG. 9B illustrates a perspective view of the thinned antenna 900 in accordance with some aspects. The thinned antenna 900 apparatus can be fabricated in one or more layers of a board assembly 914 as described below. The thinned antenna 900 apparatus includes an annular patch antenna fabricated in the board assembly 914 and having a rectangular outside perimeter. The thinned antenna 900 further includes a rectangular patch antenna 902 fabricated in the board assembly 914.

The thinned antenna 900 further includes a parasitic layer 906 gap-coupled to the annular patch antenna 904 and to the rectangular patch antenna 902 and disposed outside the rectangular outside perimeter. The parasitic layer 906 can be co-planar with the annular patch antenna 904 in a first layer 916 of the board assembly. The rectangular patch antenna 902 can be disposed on a plane 918 between a ground plane 920 of the board assembly and the first layer 916 of the board assembly.

The thinned antenna 900 can further include first, second and third feeds 908, 910, and 912. The parasitic layer 906 is shared between the annular patch antenna 904 and the rectangular patch antenna 902 through a common feed 910. The parasitic layer 906 can be used with the rectangular patch antenna 902 for high band (e.g., 37-42.5 GHz, vertical or horizontal polarization) operation or with the annular patch antenna 904 for low band (e.g., 24-29.5 GHz, vertical or horizontal polarization) operation. The thinned antenna 900 can be less than 0.85 millimeters in thickness. In some examples, the thinned antenna 900 will be about 0.5 millimeters thick 917.

Other Apparatuses

Figure 10:
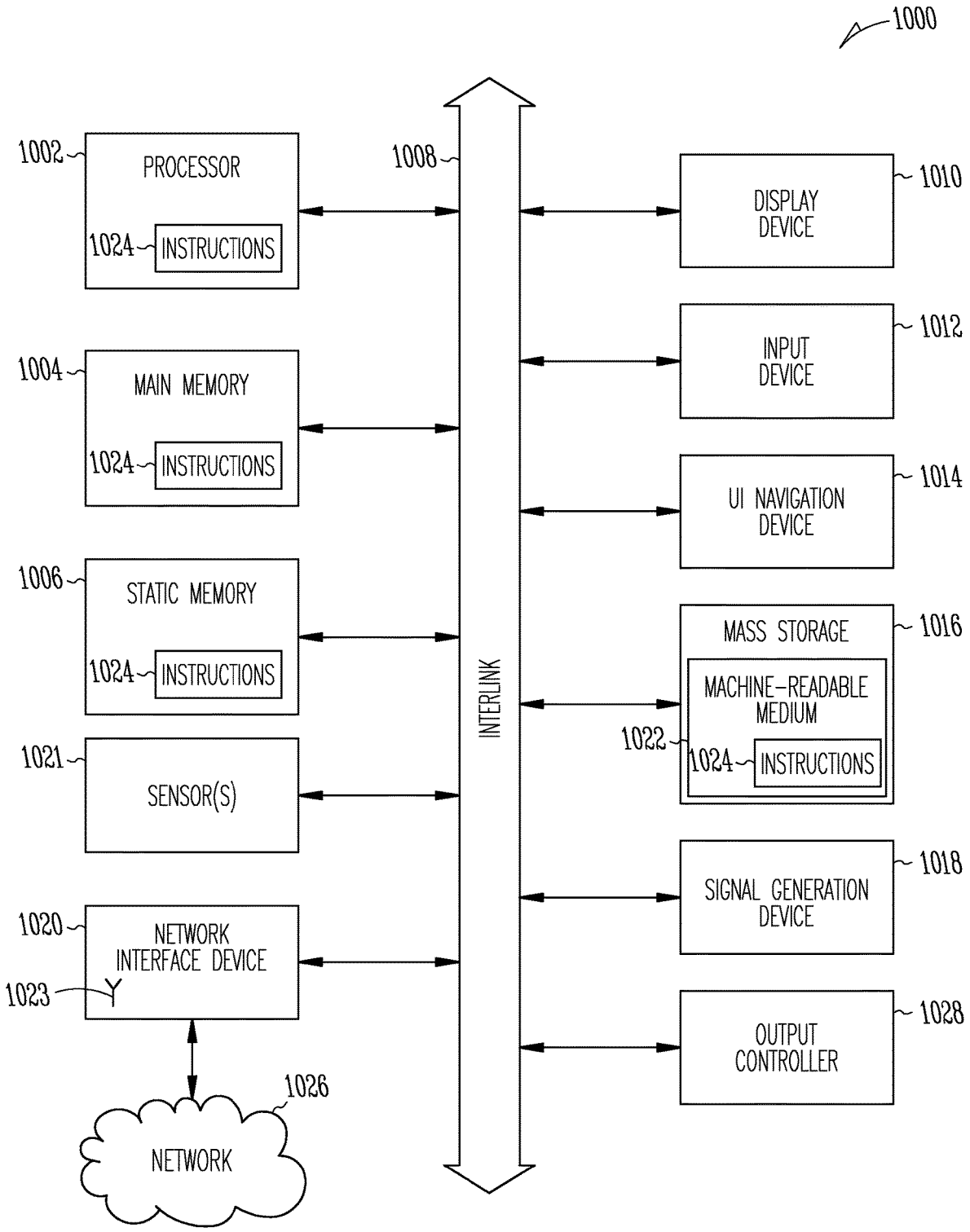
FIG. 10 illustrates a block diagram of an example machine upon which any one or more of the techniques (e.g., methodologies) discussed herein may perform.

FIG. 10 illustrates a block diagram of an example machine 1100 upon which any one or more of the techniques (e.g., methodologies) discussed herein may perform. In alternative aspects, the machine 1000 may operate as a standalone device or may be connected (e.g., networked) to other machines. In a networked deployment, the machine 1000 may operate in the capacity of a server machine, a client machine, or both in server-client network environments. In an example, the machine 1000 may act as a peer machine in peer-to-peer (P2P) (or other distributed) network environment. Further, while only a single machine is illustrated, the term "machine" shall also be taken to include any collection of machines that individually or jointly execute a set (or multiple sets) of instructions to perform any one or more of the methodologies discussed herein, such as cloud computing, software as a service (SaaS), other computer cluster configurations.

Examples, as described herein, may include, or may operate by, logic or a number of components, or mechanisms. Circuitry is a collection of circuits implemented in tangible entities that include hardware (e.g., simple circuits, gates, logic, etc.). Circuitry membership may be flexible over time and underlying hardware variability. Circuitries include members that may, alone or in combination, perform specified operations when operating. In an example, hardware of the circuitry may be immutably designed to carry out a specific operation (e.g., hardwired). In an example, the hardware of the circuitry may include variably connected physical components (e.g., execution units, transistors, simple circuits, etc.) including a computer readable medium physically modified (e.g., magnetically, electrically, moveable placement of invariant massed particles, etc.) to encode instructions of the specific operation. In connecting the physical components, the underlying electrical properties of a hardware constituent are changed, for example, from an insulator to a conductor or vice versa. The instructions enable embedded hardware (e.g., the execution units or a loading mechanism) to create members of the circuitry in hardware via the variable connections to carry out portions of the specific operation when in operation. Accordingly, the computer readable medium is communicatively coupled to the other components of the circuitry when the device is operating. In an example, any of the physical components may be used in more than one member of more than one circuitry. For example, under operation, execution units may be used in a first circuit of a first circuitry at one point in time and reused by a second circuit in the first circuitry, or by a third circuit in a second circuitry at a different time.

Machine (e.g., computer system) 1000 may include a hardware processor 1002 (e.g., a central processing unit (CPU), a graphics processing unit (GPU), a hardware processor core, or any combination thereof), a main memory 1004 and a static memory 1006, some or all of which may communicate with each other via an interlink (e.g., bus) 1008. The machine 1000 may further include a display unit 1010, an alphanumeric input device 1012 (e.g., a keyboard), and a user interface (UI) navigation device 1014 (e.g., a mouse). In an example, the display unit 1010, alphanumeric input device 1012 and UI navigation device 1014 may be a touch screen display. The machine 1000 may additionally include a storage device (e.g., drive unit) 1016, a signal generation device 1018 (e.g., a speaker), a network interface device 1020, and one or more sensors 1021, such as a global positioning system (GPS) sensor, compass, accelerometer, or other sensor. The machine 1000 may include an output controller 1028, such as a serial (e.g., universal serial bus (USB), parallel, or other wired or wireless (e.g., infrared (IR), near field communication (NFC), etc.) connection to communicate or control one or more peripheral devices (e.g., a printer, card reader, etc.).

The storage device 1016 may include a machine readable medium 1022 on which is stored one or more sets of data structures or instructions 1024 (e.g., software) embodying or utilized by any one or more of the techniques or functions described herein. The instructions 1024 may also reside, completely or at least partially, within the main memory 1004, within static memory 1006, or within the hardware processor 1002 during execution thereof by the machine 1000. In an example, one or any combination of the hardware processor 1002, the main memory 1004, the static memory 1006, or the storage device 1016 may constitute machine readable media.

While the machine readable medium 1022 is illustrated as a single medium, the term "machine readable medium" may include a single medium or multiple media (e.g., a centralized or distributed database, and/or associated caches and servers) configured to store the one or more instructions 1024.

The term "machine readable medium" may include any medium that is capable of storing, encoding, or carrying instructions for execution by the machine 1000 and that cause the machine 1000 to perform any one or more of the techniques of the present disclosure, or that is capable of storing, encoding or carrying data structures used by or associated with such instructions. Non-limiting machine readable medium examples may include solid-state memories, and optical and magnetic media. In an example, a massed machine readable medium comprises a machine readable medium with a plurality of particles having invariant (e.g., rest) mass. Accordingly, massed machine-readable media are not transitory propagating signals. Specific examples of massed machine readable media may include: non-volatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; and CD-ROM and DVD-ROM disks.

The instructions 1024 may further be transmitted or received over a communications network 1026 using a transmission medium via the network interface device 1020 utilizing any one of a number of transfer protocols (e.g., frame relay, internet protocol (IP), transmission control protocol (TCP), user datagram protocol (UDP), hypertext transfer protocol (HTTP), etc.). Example communication networks may include a local area network (LAN), a wide area network (WAN), a packet data network (e.g., the Internet), mobile telephone networks (e.g., cellular networks), Plain Old Telephone (POTS) networks, and wireless data networks (e.g., Institute of Electrical and Electronics Engineers (IEEE) 802.6 family of standards known as Wi-Fi®, IEEE 802.16 family of standards known as WiMax®), IEEE 802.15.4 family of standards, peer-to-peer (P2P) networks, among others. In an example, the network interface device 1020 may include one or more physical jacks (e.g., Ethernet, coaxial, or phone jacks) or one or more antennas 1023, as discussed above, to connect to the communications network 1026. In an example, the network interface device 1020 may include a plurality of antennas 1023 to wirelessly communicate using at least one of single-input multiple-output (SIMO), MIMO, or multiple-input single-output (MISO) techniques. The term "transmission medium" shall be taken to include any intangible medium that is capable of storing, encoding or carrying instructions for execution by the machine 1000, and includes digital or analog communications signals or other intangible medium to facilitate communication of such software.

The above detailed description includes references to the accompanying drawings, which form a part of the detailed description. The drawings show, by way of illustration, specific aspects in which the invention can be practiced. These aspects are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "where." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The following describes various examples of apparatuses and systems (e.g., antenna assemblies, or other apparatus) discussed herein.

Example 1 is an apparatus comprising a board assembly; a first antenna disposed within the board assembly; a second antenna disposed within the board assembly; and a third antenna comprising a semiconductor antenna attached to the board assembly.

In Example 2, the subject matter of Example 1 can optionally include wherein the first antenna includes a first patch antenna.

In Example 3, the subject matter of Example 2 can optionally include wherein the first patch antenna includes a first indirect feed probe.

In Example 4, the subject matter of Example 3 can optionally include wherein the first indirect feed probe includes a waveguide.

In Example 5, the subject matter of any of Examples 1-4 can optionally include wherein the second antenna includes a second patch antenna.

In Example 6, the subject matter of Example 5 can optionally include wherein the second patch antenna includes a second indirect feed probe.

In Example 7, the subject matter of any of Examples 1-6 can optionally include wherein the second antenna is disposed in a layer of the board assembly, the layer disposed between a plane of the first antenna and a plane of the third antenna.

In Example 8, the subject matter of Example 2 can optionally include wherein the first patch antenna includes a first metal patch in a first layer of the board assembly and a first parasitic patch in a second layer of the board assembly.

In Example 9, the subject matter of Example 8 can optionally include wherein the first metal patch is an annular ring.

In Example 10, the subject matter of Example 9 can optionally include wherein the annular ring includes a rectangular outside perimeter and a rectangular inside perimeter.

In Example 11, the subject matter of Example 8 can optionally include wherein the second antenna includes a second metal patch in a third layer of the board assembly; and a second parasitic patch in a fourth layer of the board assembly.

In Example 12, the subject matter of Example 11 can optionally include wherein the second metal patch is a regular rectangular metal patch.

In Example 13, the subject matter of Example 12 can optionally include wherein the first metal patch is an annular ring.

In Example 14, the subject matter of Example 13 can optionally include wherein the annular ring includes a rectangular outside perimeter and a rectangular inside perimeter.

In Example 15, the subject matter of Example 14 can optionally include wherein the first parasitic patch is a second annular ring.

In Example 16, the subject matter of Example 15 can optionally include wherein the second annular ring includes a rectangular outside perimeter and a rectangular inside perimeter.

In Example 17, the subject matter of any of Examples 11-16 can optionally include wherein the second layer and the fourth layer are the same layer.

In Example 18, an antenna array system can comprise a board assembly having four composite low frequency antenna array elements; and a semiconductor coupled to the board assembly, the semiconductor having four high frequency array elements.

In Example 19, the subject matter of Example 18 can optionally include wherein each of the four composite low frequency antenna array elements is configured to support dual polarized capabilities.

In Example 20, the subject matter of any of Examples 18-19 can optionally include wherein each of the composite low frequency antenna array elements includes a rectangular annular ring patch antenna and a regular rectangular patch antenna.

In Example 21, the subject matter of any of Examples 18-20 can optionally include a controller configured to transmit a first signal having a first polarization and first frequency using a first antenna of each of the four composite low frequency antenna array elements, to transmit a second signal having a second polarization and second frequency using a second antenna of each of the four composite low frequency antenna array elements, and to transmit a third signal having a third frequency using each antenna of the four high frequency array elements; and wherein the first frequency is 24-29.5 GHz, the second frequency is 37-43.5 GHz (40 GHz), and the third frequency is 57-70 GHz.

In Example 22, an apparatus (e.g., antenna or antenna assembly or other device) can include a board assembly; an annular patch antenna disposed within the board assembly and having a rectangular outside perimeter; a rectangular patch antenna disposed within the board assembly; and a parasitic layer gap-coupled to the annular patch antenna and to the rectangular patch antenna and outside the rectangular outside perimeter.

In Example 23, the subject matter of Example 22 can optionally include wherein the parasitic layer is co-planar with the annular patch antenna in a first layer of the board assembly.

In Example 24, the subject matter of any of Examples 22-23 can optionally include wherein the rectangular patch antenna is disposed on a plane between a ground plane of the board assembly and the first layer of the board assembly.

In Example 25, the subject matter of any of Examples 22-24 can optionally include wherein the parasitic layer is shared between the annular patch antenna and the rectangular patch antenna through a common feed.

The above description is intended to be illustrative, and not restrictive. For example, the above-described examples (or one or more aspects thereof) may be used in combination with each other. Other aspects can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed aspect. Thus, the following claims are hereby incorporated into the Detailed Description, with each claim standing on its own as a separate aspect, and it is contemplated that such aspects can be combined with each other in various combinations or permutations. The scope of the invention should be determined with reference to the appended claims, along with the full scope of equivalents to which such claims are entitled.

What is claimed is:

1. An apparatus comprising:

a board assembly;

an annular patch antenna disposed within the board assembly and having a rectangular outside perimeter, the annular patch antenna electrically coupled to a first feed;

a rectangular patch antenna disposed within the board assembly the rectangular patch antenna electrically coupled to a second feed; and a parasitic layer gap-coupled to the annular patch antenna and to the rectangular patch antenna and disposed outside the rectangular outside perimeter, wherein the annular patch antenna and the rectangular patch antenna are electrically coupled to a common feed.

2. The apparatus of claim 1, wherein the parasitic layer is co-planar with the annular patch antenna in a first layer of the board assembly.

3. The apparatus of claim 2, wherein the rectangular patch antenna is disposed on a plane between a ground plane of the board assembly and the first layer of the board assembly.

4. The apparatus of claim 1, wherein the common feed allows the parasitic layer to be shared between the annular patch antenna and the rectangular patch antenna through gap coupling, and wherein the parasitic layer is electrically isolated from annular patch antenna and the rectangular patch antenna.

* * * * *